US006144002A

United States Patent [19]

Coudert et al.

[11] Patent Number: 6,144,002

[45] Date of Patent: Nov. 7, 2000

[54] SWITCHGEAR APPARATUS COMPRISING A MECHANICAL VISUALIZATION MEANS WITH THREE POSITIONS

[75] Inventors: Patrick Coudert, Varces; Claude Grelier, Crolles; Eric Pinero, Seyssinet, all of France

[73] Assignee: Schneider Electric Industries SA, France

[21] Appl. No.: 09/406,777

[22] Filed: Sep. 28, 1999

[30] Foreign Application Priority Data

Oct. 30, 1998 [FR] France ..... 98 13881

[51] Int. Cl.[7] ..... H01H 5/00; H01H 9/16; H01H 9/20

[52] U.S. Cl. ..... 200/400; 200/308

[58] Field of Search ..... 200/17 R, 400, 200/401, 500, 501, 308, 318, 323, 324, 325

[56] References Cited

U.S. PATENT DOCUMENTS 4,301,342 11/1981 Castonguay et al. ..... 200/153 SC
4,409,449 10/1983 Takano et al. ..... 200/153 SC
5,504,290 4/1996 Baginski et al. ..... 200/401
5,584,383 12/1996 Matsuo et al. ..... 200/400
5,981,887 11/1999 Robarge et al. ..... 200/308
5,981,888 11/1999 Robarge et al. ..... 200/400

FOREIGN PATENT DOCUMENTS 2932355 2/1981 Germany ..... H01H 3/30

*Primary Examiner*—Michael Friedhofer
*Attorney, Agent, or Firm*—Parkhurst & Wendel, L.L.P.

[57] ABSTRACT

A switchgear apparatus having at least one movable contact biased in an open position by an opening spring, a loading mechanism of a closing spring and a kinematic opening and closing system linking the closing spring, the movable contact and the opening spring. The system is controlled by an opening latch and a closing latch. A closing order can be validly transmitted only to the closing latch when the apparatus is in a "ready to close" state, i.e. open, loaded and without a permanent opening order. The switchgear apparatus has an indicator with three positions: a "not loaded" position, a "ready to close" position, and a third "loaded and not ready to close" or "loaded disengaged" position. The indicator is kinematically linked to the loading mechanism, the opening latch, and the movable contact.

9 Claims, 9 Drawing Sheets

SWITCHGEAR APPARATUS COMPRISING A MECHANICAL VISUALIZATION MEANS WITH THREE POSITIONS

BACKGROUND OF THE INVENTION

The invention relates to an electrical switchgear apparatus of the kind described in the document EP A 0,222,645, for instance a circuit breaker comprising at least one pair of contacts at least one of which is movable and can take with respect to the other a closed position corresponding to mechanical and electrical contact and an open position, this circuit breaker being of the type equipped with a loading mechanism equipped with an energy storage means and with an opening mechanism. The loading mechanism comprises a spring called the closing spring able to move from a loaded state to a released state, and a latch called the closing latch able to lock the closing spring in its loaded state. The closing spring is associated to the movable contact in such a way that release of the closing spring moves the movable contact to its closed position. The loading and closing mechanism comprises in addition a drive mechanism whose drive means, for example an oscillating handle, drives a free-wheel mechanism designed to move the closing spring to its loaded state. The opening mechanism comprises a spring called the opening spring able to move from a loaded state to a released state and from the released state to the loaded state, and a latch called the opening latch able to lock the opening spring in its loaded state. The opening spring is associated to the movable contact in such a way that release of the opening spring moves the movable contact to an open position and that movement of the movable contact to its closed position results in loading of the opening spring.

Such a circuit breaker may be in different states, in particular a closed state, an unloaded open state, and a loaded open state. In the loaded and unloaded open states, the opening latch may be either in the unlatched position, which is generally a rest position in which the latch is flexibly returned, or in the latched position. The latch may in fact be solicited continuously to the latter position, for example by a trip device activating it due to an electrical fault persisting on the line, or by an opening push-button itself latched by an external latch to enable an operation to be carried out on the switchgear apparatus.

The circuit breaker must, however, in practice only be reclosed if three conditions are met: the loading mechanism must be loaded, the switching bar must be in the open position, and the opening latch must be in its latched position. These three conditions being conjunctively met defines a state of the circuit breaker called "ready to close". The 1989 Merlin Gerin low-voltage distribution catalogue references a circuit breaker of Masterpact brand-name presenting an indicator of this ready to close state of the switchgear apparatus. The internal operation of this state of the technique device is represented in FIGS. 1 to 3. The loading mechanism 10 of the circuit breaker 12 comprises an energy storage means with a spring 14 cooperating with a transmission lever 16. The lever 16 is mounted pivoting around a fixed spindle 18 and comprises a roller 20 interfering with a loading cam 22 mounted on a shaft 24. The shaft 24 supports a secondary indexing cam 26 of the state of the circuit breaker 12, interfering with a finger 28 of an indicator 30 pivoting around a fixed spindle 32. The indicator 30 comprises a wall 34 in the form of a cylinder sector, visible through a window 36 of the control panel 38 of the front face of the switchgear apparatus. The indicator 30 can take two positions: one, represented in FIGS. 2 and 3, representative of the not loaded state of the loading mechanism 10 and the other, represented in FIG. 1, representative of the loaded state. In the loaded state of the loading mechanism, i.e. when the spring 14 is stretched to the maximum, in FIG. 1, the finger 28 falls into a notch 40 of the indexing cam 26 and the indicator 30 pivots to a position such that a symbol of the loaded state of the circuit breaker appears in the window 36. When the mechanism is not loaded, the finger 28 interferes with the cylindrical periphery 42 of the cam 26 so that a different part of the wail 34 bearing a corresponding symbol appears in the window. The indicator 30 moreover comprises an arm 44 acting on a slide rack 46 in such a way that the slide rack 46 is pushed to the left in the figures, so long as the circuit breaker is not in its loaded state. Moreover, the circuit breaker has an opening indicator 48 visible in FIG. 3 and fitted on a spindle 50 extending that of the loading indicator 30, in a plane parallel to that of FIG. 1. The opening indicator 48 is biased to an angular position, not represented, in which it lets a symbol of the open state of the circuit breaker appear through a window 52 of the control panel 38. The indicator 48 comprises in addition a finger 54 which interferes with a cam 56 borne by the switching bar 58 when the latter reaches its closed position, so as to make the indicator 48 pivot, which indicator is in the position represented in FIG. 3, in which it lets a symbol of the closed state of the circuit breaker appear through the window 52. In this position, an arm 60 securedly affixed to the indicator interferes with the slide rack 46 in such a way that the slide rack 46 is pushed to the left in the figures so long as the circuit breaker is not in its open state. The opening mechanism of the circuit breaker 12 comprises in addition an opening latch 64 able to take a latched position, represented in FIG. 2, in which it prevents the switching bar 58 from moving from its closed position to its open position, and an unlatched position, represented in FIGS. 1 and 3, in which it allows this movement. The opening latch 64 has an arm 66 acting on the slide rack 46 and pushing the latter to the left in FIG. 2, so long as the latch is in the unlatched position. The slide rack 46 is biased flexibly to the right in the figures, but it can only reach the position of FIG. 1 when all of the three conditions of the "ready to close" state are met with. In this position, the indicator slide rack 46 activates an electrical contact, not represented, which activates a lighted indicator on the control panel 38. Furthermore, it forms in this position, and in this position only, a kinematic link between a closing push-button 68 and a closing latch 70 designed to release the loading cam 22, so that any closing order by the push-button 68 is inoperative so long as the apparatus is not in its ready to close state. This device presents the drawback of not comprising a mechanical indicator, i.e. a purely mechanical device visible by the operator and indicating by its position or its state the "ready to close" state of the apparatus.

To solve this problem, it was proposed in the document EP-A-0,721,647 to provide a mechanical indicator specific of the ready to close state of the apparatus, taking information from a movable part one position of which is specific of the ready to close state. This solution is relatively cumbersome to implement due to the numerous specific parts it involves and to its size. Furthermore, it provides the human operator with superabundant information which does not always prove practical.

SUMMARY OF THE INVENTION

The object of the present invention is therefore to provide the operator with mechanical information representative of the ready to close state of the switchgear apparatus, in inexpensive, non cumbersome, and practical to read form.

According to the invention, this problem is solved due to a switchgear apparatus comprising:

one or more poles each comprising at least one pair of contact means, at least one of the contact means of each pair being movable in such a way that the pair of contact means is able to take an open position and a closed position, an opening spring, an energy storage means, a loading mechanism kinematically linked to the energy storage means so as to load the energy storage means whatever the position of the pair or pairs of contact means, a latch called the closing latch able to lock the energy storage means in its loaded state, a kinematic system linking the energy storage means, the opening spring and the movable contact means in such a way that discharging of the energy storage means moves the pair or pairs of contact means to their closed position and loads the opening spring, and that the loaded opening spring biases the pair or pairs of contact means to their open position, a latch called the opening latch able to cooperate with the kinematic system and to take a latched position in which it prevents the pair or pairs of contact means from moving from their closed position to their open position, and an unlatched position in which it enables this movement, an indicating device comprising:

an indicator kinematically linked to the loading mechanism and able to take a "not loaded" position and at least a second position, and to take its "not loaded" position if and only if the energy storage means is not in its loaded state, a mechanical indicator of a "ready to close" state of the apparatus, kinematically connected to the pair or pairs of contact means and to the opening latch, taking a position called "ready to close" if and only if the pair or pairs of contact means are in the open position, the energy storage means is loaded and the opening latch is in its latched position, a switchgear apparatus wherein the indicator constitutes the mechanical indicator of the "ready to close" state of the apparatus, the "ready to close" position constituting a third position of the indicator, the second position of the indicator being taken when the energy storage means is loaded and the apparatus is not in its "ready to close" state.

The structure obtained is simpler since it only requires a single indicator instead of the two required previously. This arrangement is moreover advantageous from an ergonomic point of view, as the operator receives relevant information only, and not uselessly redundant information, indicating to him the "not loaded", "loaded ready to close" and "ready to close" states. The "not ready to close" state of the state of the technique indicator does not in fact provide any additional information when the loading indicator is in the "not loaded" position.

Preferably the indicator is kinematically linked to a transmission means disposed between the closing control means and the energy storage means, in such a way that the transmission means is able to transmit the mechanical order from the closing control means to the closing latch if and only if the indicator is in the "ready to close" position. The indicator then becomes multifunctional, as it controls inactivation of the closing control means, whence the number of parts being reduced. The disengagement function of the closing control means is useful to prevent no-load closings, i.e. on a switchgear apparatus whose opening latch is in the unlatched position. No-load closing in fact causes a large energy discharge which has to be absorbed by end of travel stops dimensioned for smaller impacts. Preferably the transmission means does not interfere with the closing control means when the indicator is not in its "ready to close" position, so that the control means is disengaged. In this case, inactivation of the closing control means is performed by disengagement: in practice, the operator who operates the closing control means does not transmit any mechanical stress to the closing latch, to the transmission means or to the indicator. Preferably the indicator comprises a cooperation surface able to cooperate directly or indirectly with the transmission means.

Preferably the indicator is mounted pivoting around a spindle. Alternatively, the invention can be implemented with an indicator movable in translation, or according to any other suitable trajectory.

Preferably the indicator comprises a cooperation surface able to cooperate directly or indirectly with the opening latch.

Advantageously the indicator comprises a cooperation surface able to cooperate directly or indirectly with the pair or pairs of contact means, in particular with a switching bar connecting the movable contact means.

Preferably the indicator comprises a cooperation surface able to cooperate directly or indirectly with the loading mechanism, in particular with its driving device.

Alternatively, the kinematic link between the indicator and the opening latch, the switching bar, the loading mechanism or the transmission means may not implement a cam, but any other type of suitable link, for example by cables.

Alternatively, the invention can also be implemented with an intermediate movable part distinct from the indicator, kinematically linked to the latter and cooperating by means of cams or any other suitable means with the opening latch, the switching bar, the loading mechanism and possibly the transmission means.

Advantageously the indicator comprises a cooperation surface, formed for example by an arm or a cam, able to cooperate directly or indirectly with an electrical switch so as to close the latter if and only if the indicator is in its "ready to close" state. The electrical information thus obtained enables a signal to be sent to the control panel of the circuit breaker and to internal or external monitoring devices.

BRIEF DESCRIPTION OF THE DRAWINGS

Other advantages and features of the invention will become more clearly apparent from the following description of an embodiment of the invention, given as a nonrestrictive example only and represented in the accompanying drawings in which.

DETAILED DESCRIPTION OF THE PREFERRED EMBODIMENT

Figure 1:
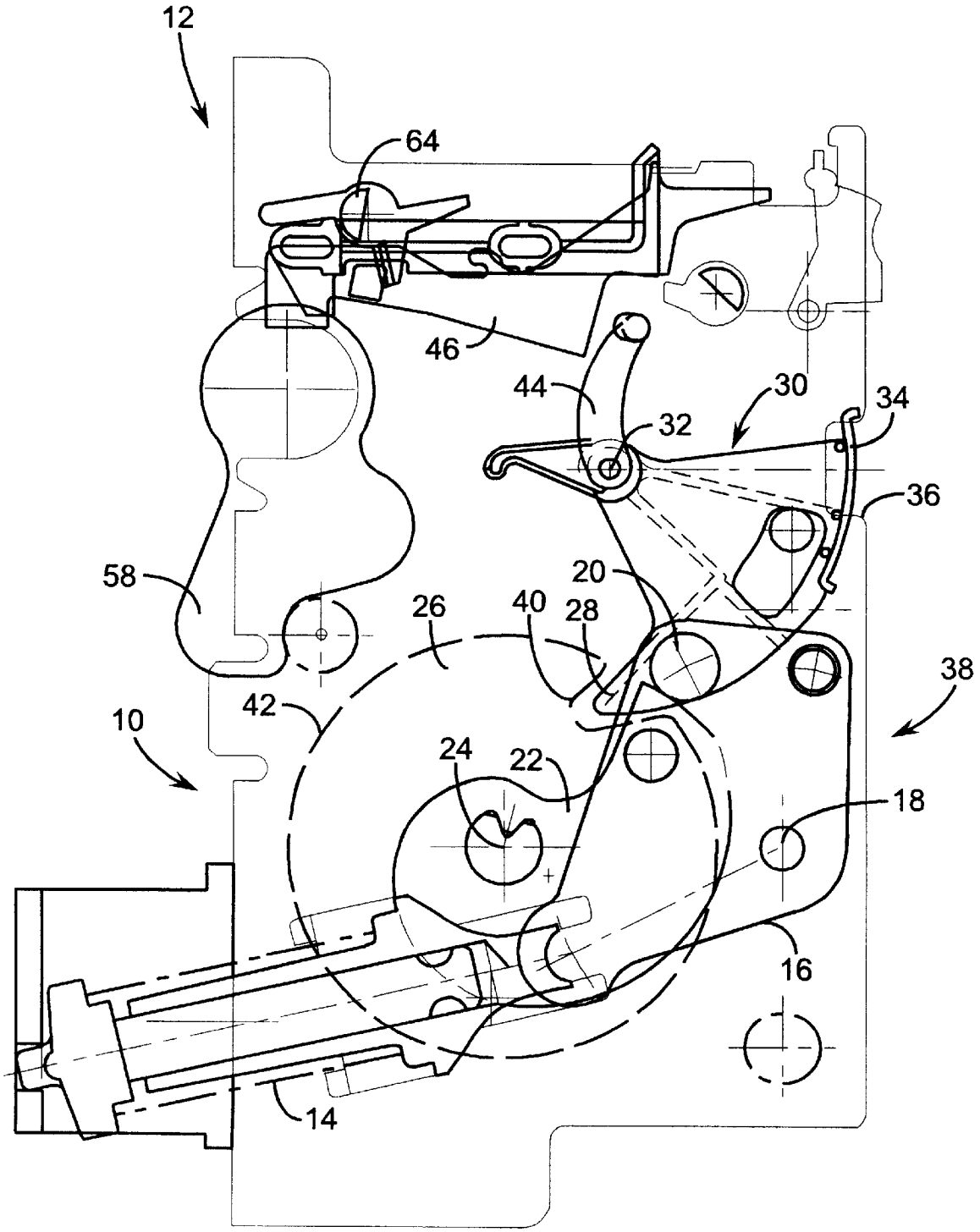
FIG. 1 PRIOR ART
FIG. 1, which has already been commented, represents a view of the state of the technique mechanism, in the ready to close state.
Figure 2:
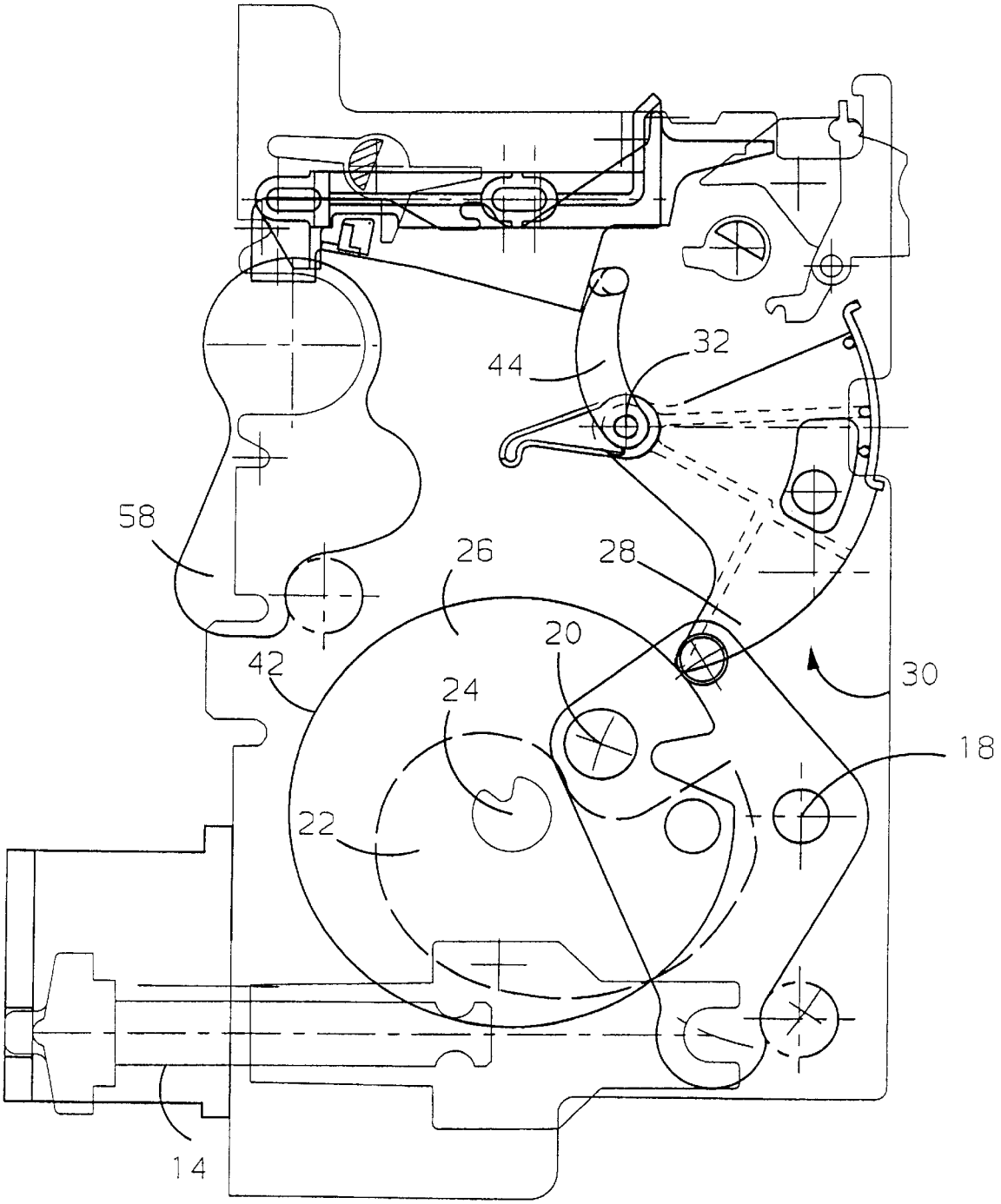
FIG. 2 PRIOR ART
FIG. 2, which has already been commented, represents a view of the state of the technique mechanism, in the open not loaded state.
Figure 3:
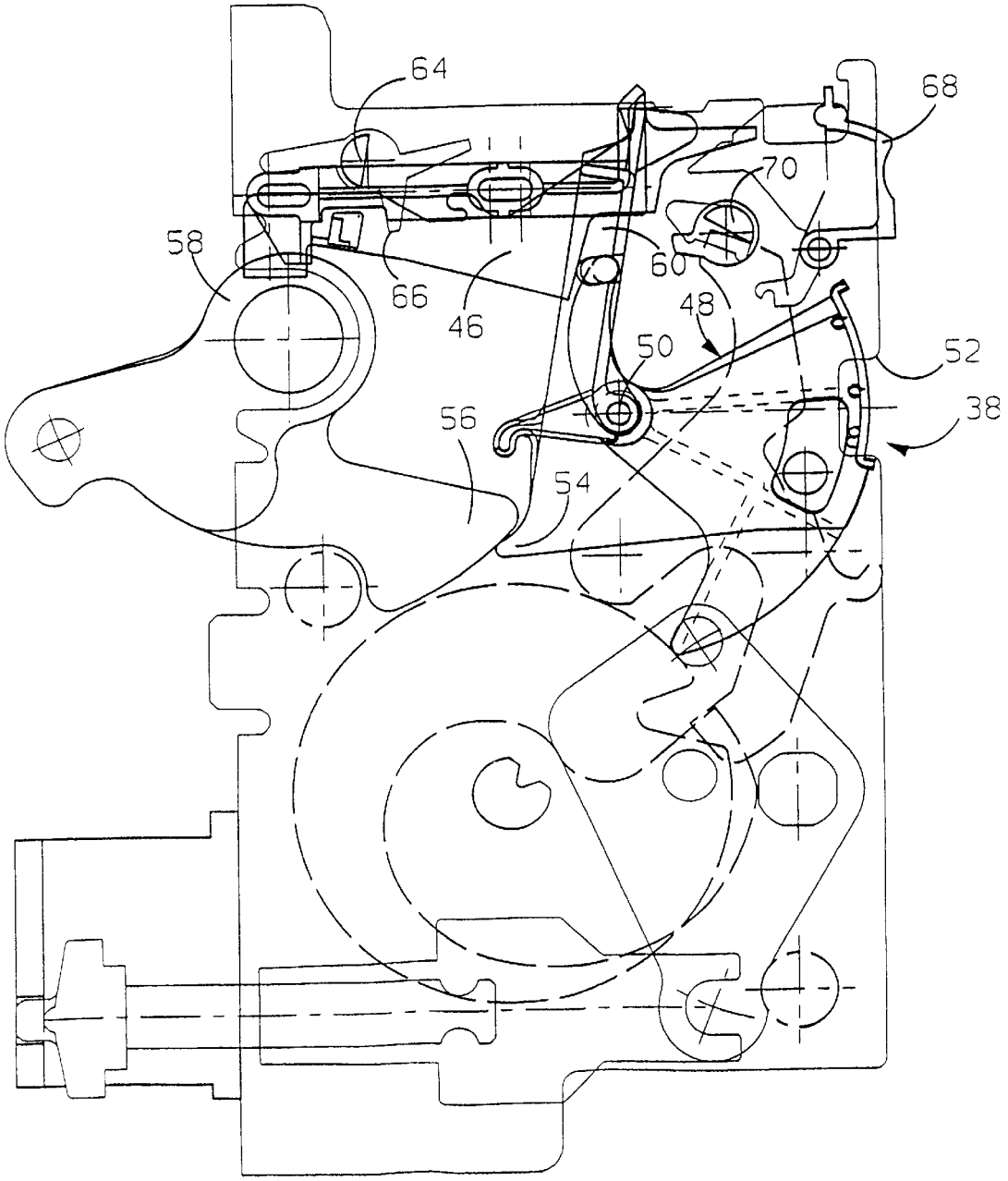
FIG. 3 PRIOR ART
FIG. 3, which has already been commented, represents a view of the state of the technique mechanism, in the closed not loaded state.
Figure 4:
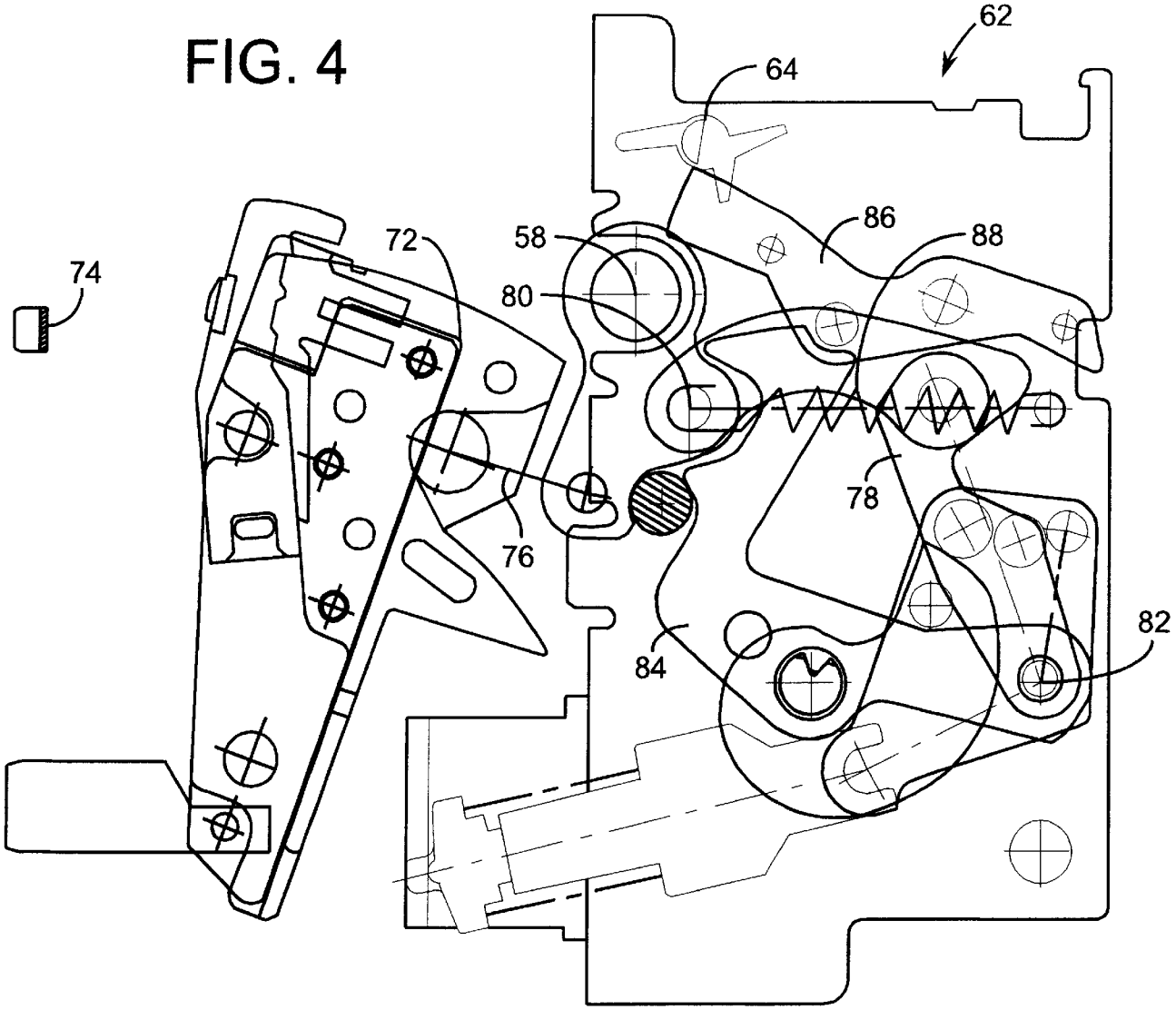
FIG. 4 is a skeleton diagram of an opening device of the poles of a circuit breaker according to a preferred embodiment of the invention, in the open position.
Figure 5:
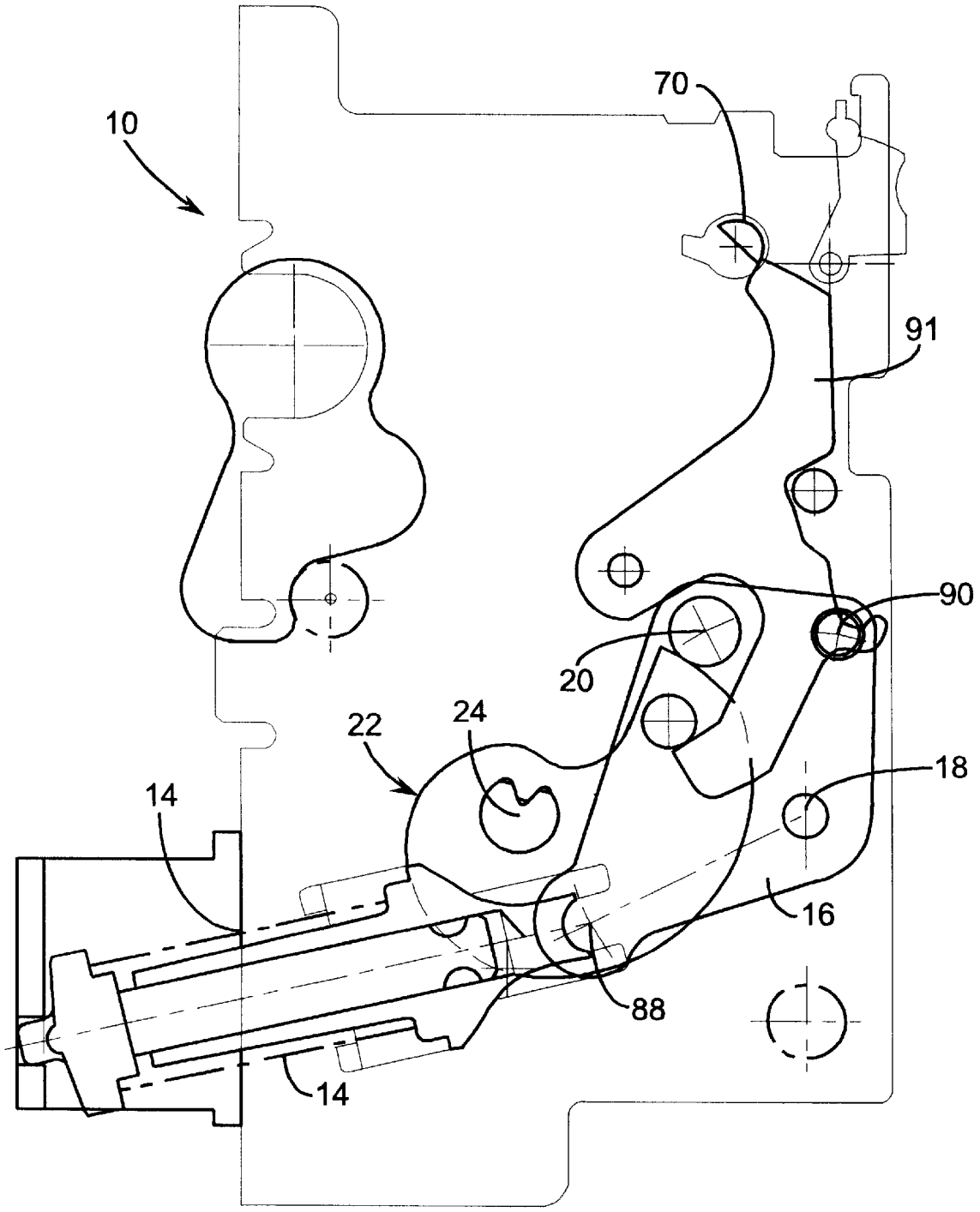
FIG. 5 is a skeleton diagram of an energy storage loading device of the circuit breaker of FIG. 4, in the loaded position.

With reference to FIGS. 4 and 5, the circuit breaker comprises a pair of separable contact means 72, 74 per pole, the movable contact means 72 of which is connected by a rod 76 to a switching bar 58 common to all of the poles, and an operating device for opening and closing of the poles, equipped with an energy storage means. The switching bar 58 is a shaft moving the contact means of the circuit breaker between an open position and their closed position. The movable contact means is itself in two parts, one forming a support pivotally mounted around a fixed spindle and biased by the rod 76, the other pivotally mounted around a spindle of the first part, and bearing the contact pads. The operating device comprises a kinematic opening and closing system 62, which can be seen in FIGS. 4 and 5, comprising a transmission lever 16, a connecting rod 78, a hook 84 and an opening ratchet 86. The connecting rod 78 is connected via one end 80 to a crank of the switching bar, whereas its other end 82 is mounted on the pivoting opening hook 84. The hook 84 is itself held in position by the opening ratchet 86 held by an opening latch 64. The connecting rod 78 can take a folded position corresponding to an open position of the switching bar 58 and an opened out position corresponding to the closed position of the switching bar 58. An opening spring 88 working in tension connects the link pivot 80 linking the connecting rod to the switching bar and a fixed pin, in such a way that it biases the switching bar 58 to the open position, and is automatically taut when closing of the poles takes place.

The operating device moreover comprises a loading mechanism 10 with energy storage which can be seen in FIG. 5, loading of which mechanism is performed by means of a reloading cam 22 keyed onto a loading shaft 24. The loading shaft 24 is driven in the clockwise direction in the figures by a ratchet a crown-wheel device, not represented. The loading cam 22 cooperates with a roller 20 of a loading lever 16. The loading lever 16 supports a connecting finger 88 with a flexible energy storage means comprising a compression spring 14, called the closing spring, guided in a telescopic support. The loading lever 16 also belongs to the kinematic opening and closing system, as it also has a finger 90 cooperating with the connecting rod 78, in such a way that pivoting of the loading lever 16 when relaxation of the closing spring 14 takes place moves the connecting rod 78 and switching bar 58 to the closed position. In the loaded position of FIG. 5, the loading cam is held in position by a closing ratchet 91, itself locked in position by a closing latch 70.

With reference to FIGS. 6 to 9, a control panel 38 of the circuit breaker 12 has a closing push-button 68 and a mechanical indicator 30 indicating the loaded or not loaded state of the switchgear. The indicator 30 constitutes a lever pivoting around a spindle 32 and presenting a visualization face 34 in the form of a cylindrical sector passing in front of a window 36 of the front panel of the circuit breaker 12. It is biased by a tension spring 92 in the clockwise direction in the figures. The indicator 30 has a first arm 28 comprising an active surface 29 cooperating with an indexing cam 26 securedly affixed to the loading shaft 24. The indexing cam 26 comprises a notch 40 in which the arm 28 is free to house itself when the loading shaft 24 reaches its loaded position, in the positions of FIGS. 7 to 9. The indicator has a second arm 54 an active surface 55 of which interferes with the switching bar 58 in the position of FIG. 7. The indicator has a third arm 94 interfering by an active surface 95 with an arm 96 of the opening latch 64 when the latter takes its unlatched position in FIG. 9. The indicator also has a fourth arm 44 an active surface 45 of which cooperates with a transmission slide rack 46. The slide rack has an oblong guide 98 cooperating with a fixed pivot 100, giving it a degree of freedom of translation and a degree of freedom of rotation. The slide rack is flexibly biased to the right in FIGS. 6 to 9 to a position where it is able to cooperate with the push-button 68, so as to transmit a closing order given manually on the push-button to the closing latch 70.

Operation of the device is as follows.

Figure 6:
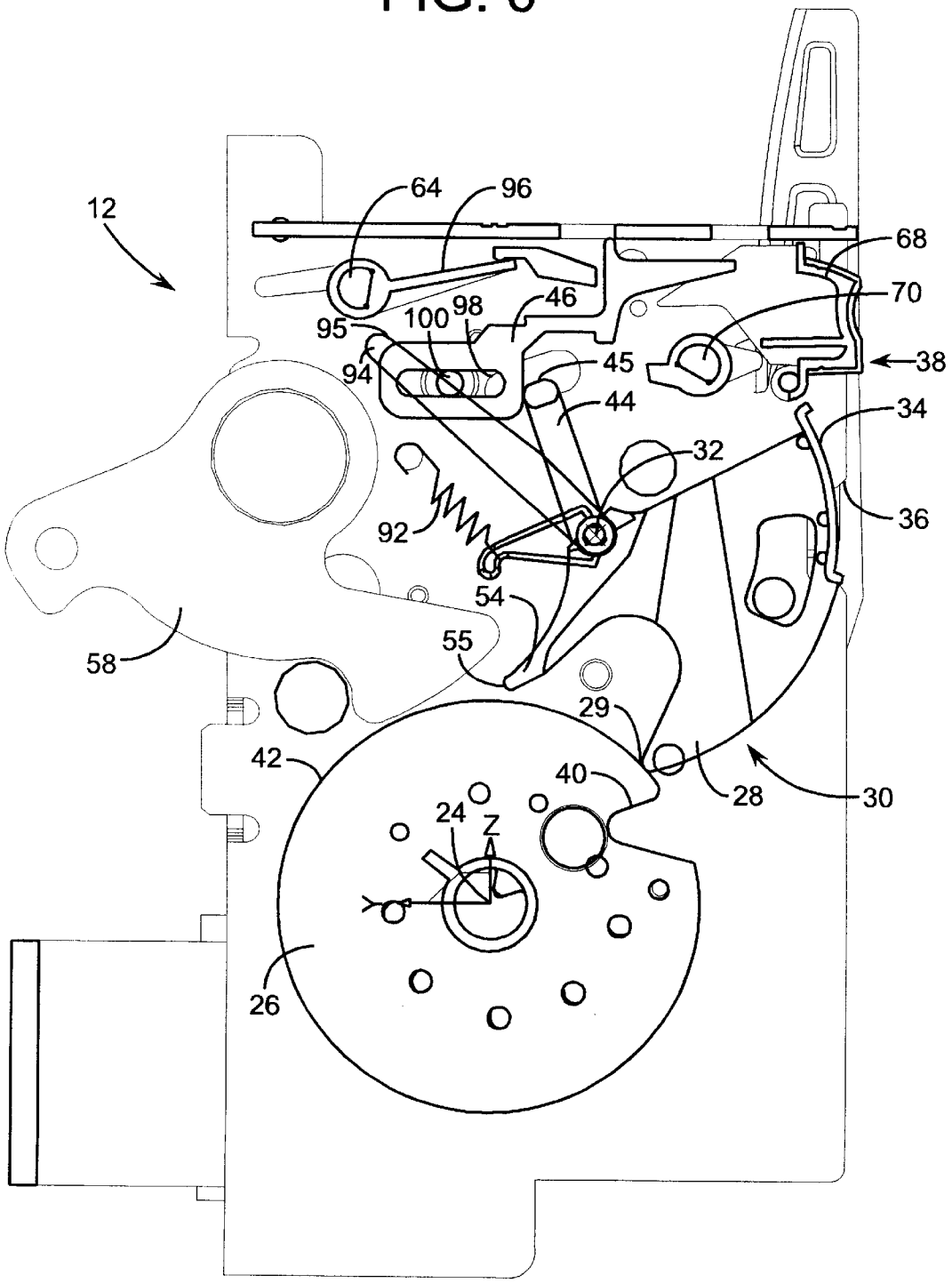
FIG. 6 represents a device according to a first embodiment of the invention, in the closed not loaded state.

In the position of FIG. 6, the switching bar 58 is in the closed position and loading of the energy storage means has not begun. The first arm 28 of the indicator is resting on the periphery 42 of the indexing cam 26 so that the indicator 30 takes a first position in which it lets a part of the cylindrical sector 34 bearing a symbol characteristic of the "not loaded" state of the circuit breaker appear through the window. In this position, the slide rack 46 is urged by the third arm 44 of the indicator 30 out of its interference position with the push-button 68 and the closing latch 70, so that the closing push-button 68 is inoperative.

Clockwise rotation of the loading shaft 24 in FIG. 6 causes rotation of the loading cam, which makes the loading lever 16 pivot around its fixed spindle 18 causing compression of the closing spring 14. At the end of loading travel, the loading cam 22 interferes with the ratchet 91 itself locked by the half-moon-shaped closing latch 70 preventing rotation from being continued. This position corresponds to an interference zone between the cam 22 and the roller 20 of the lever 16 in which the roller 20 becomes the driver and the cam 22 the receiver.

At the end of the loading travel, the first arm 28 of the indicator is located facing the notch 40 of the indexing cam. Its pivoting is however restrained by an interference of the second arm 54 with the arm of the switching bar 58 in the closed position. The indicator 30 therefore pivots, due to the bias exerted by its return spring 92, to the position of FIG. 7. In this position, the slide rack 46 is still urged by the third arm 44 of the indicator 30 out of its interference position with the push-button 68 and the closing latch 70, so that the closing push-button 68 is still inoperative. The indicator 30 lets a part of the cylindrical sector 34 appear through the window, bearing a symbol of the "loaded disengaged" state of the circuit breaker, i.e. a state in which closing of the circuit breaker is not authorized, although the loading spring 14 is taut From the position of FIG. 7, pivoting of the opening latch 64 releases the ratchet 86 which in turn releases the hook 84 which pivots in such a way that that the connecting rod 78 passes a dead point beyond which it folds in impulsive manner causing rotation of the switching bar 58 to its open position represented in FIG. 8, whereas the opening latch 64 reverts to its rest position.

In this position, none of the three arms 28, 54, 94 of the indicator 30 is solicited. The indicator 30 is therefore returned clockwise by the spring 92 until it lets a symbol of the "ready to close" state of the circuit breaker appear through the window. This pivoting of the indicator also releases the slide rack 46 which is urged to the right to take the position of FIG. 8.

Figure 8:
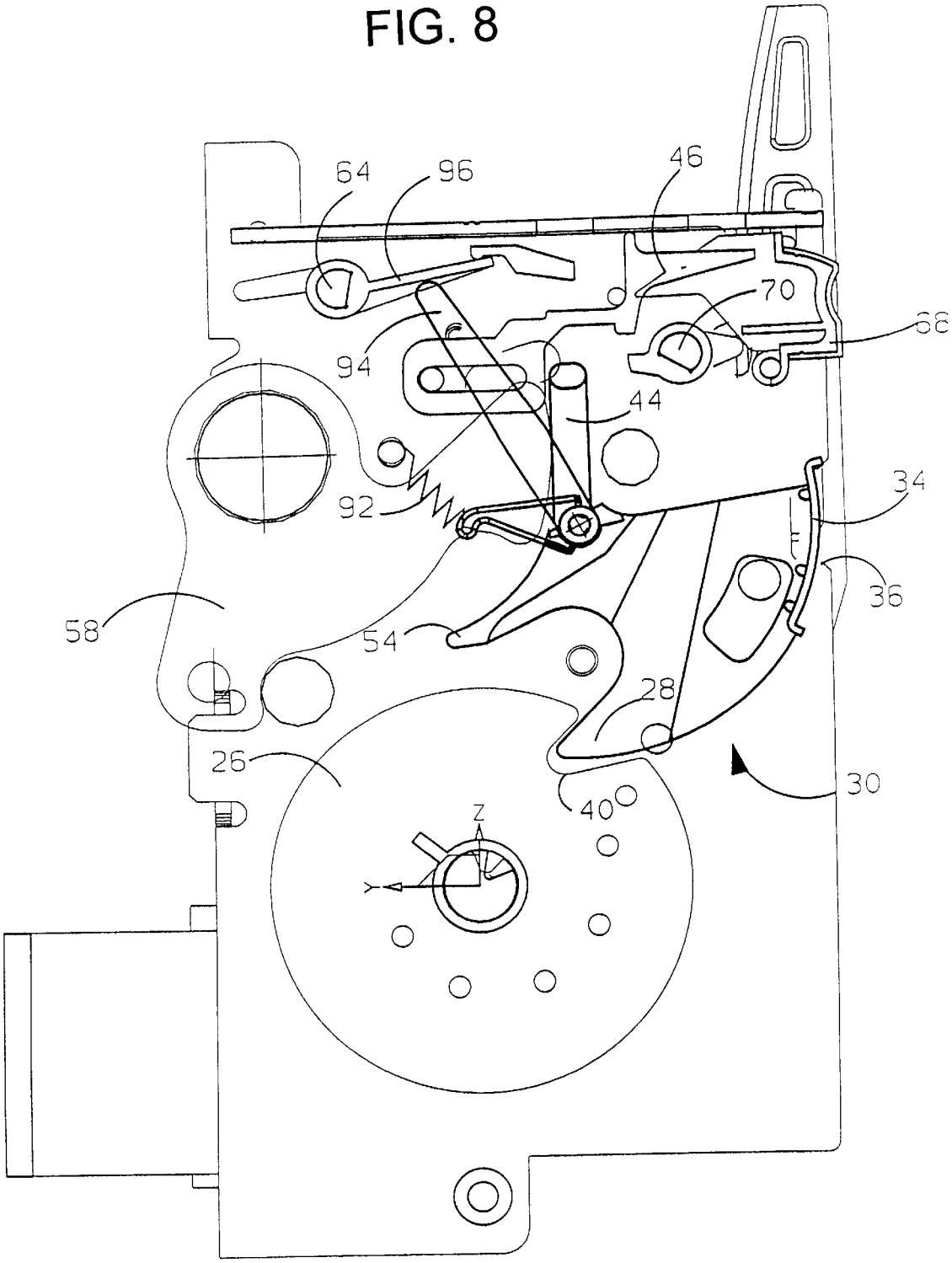
FIG. 8 represents the device of FIG. 6, in the ready to close state.

If the operator acts on the closing push-button 68 from the position of FIG. 8, the latter pivots around its spindle, makes the slide rack 46 pivot clockwise until the latter interferes with the closing latch 70 and moves it to its unlatched position. Pivoting of the closing latch 70 releases the reducer ratchet 91 and the lever 16 which, due to the force of the closing spring 14, pivots in impulse manner simultaneously moving the cam 22 and the shaft 24 back to the unloaded position. The finger 90 of the loading lever 16 causes unfolding of the connecting rod 78 and pivoting of the switching bar 58 to the closed position. At the end of this phase, the circuit breaker is in the position of FIG. 6.

Figure 7:
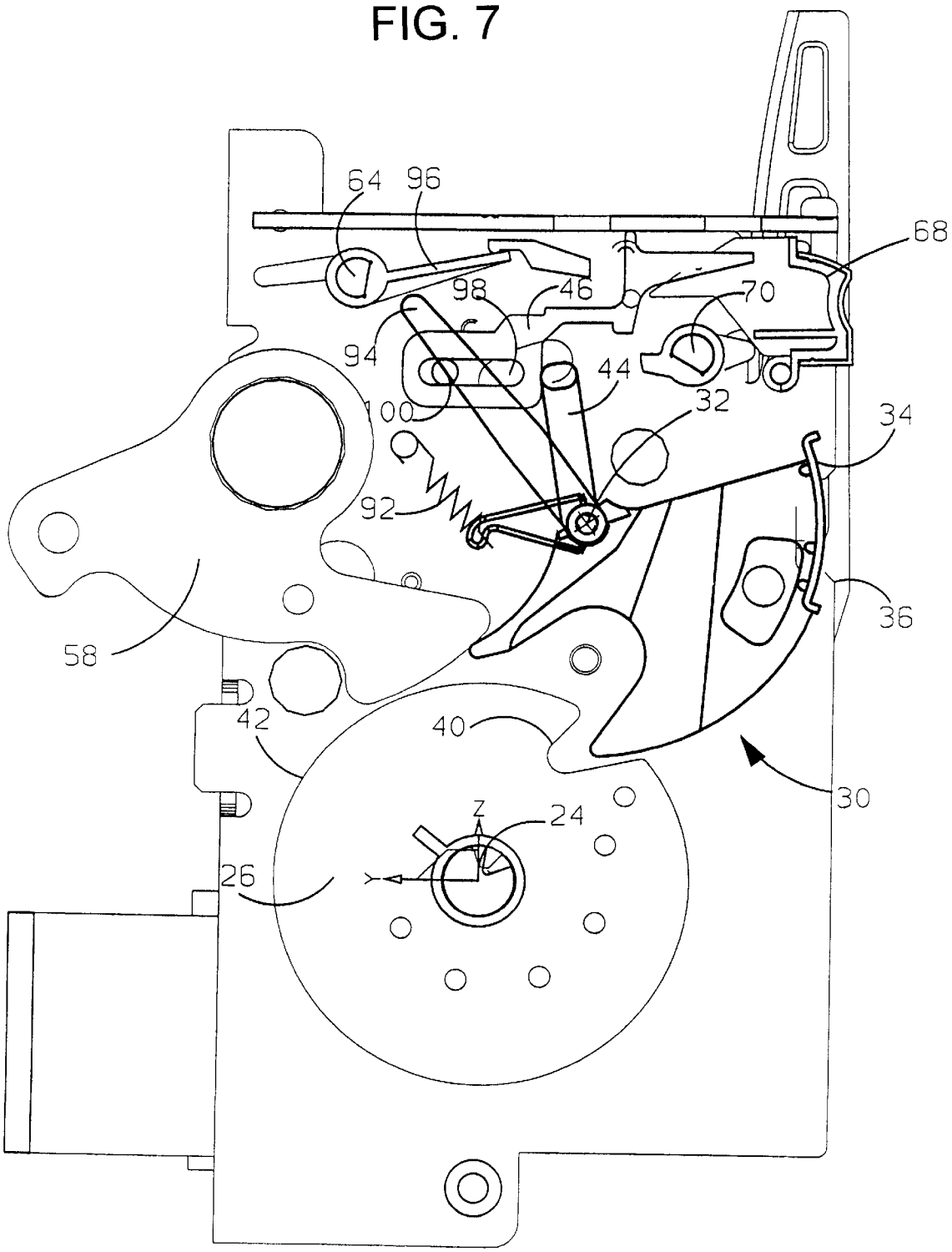
FIG. 7 represents the device of FIG. 6, in the closed loaded state.
Figure 9:
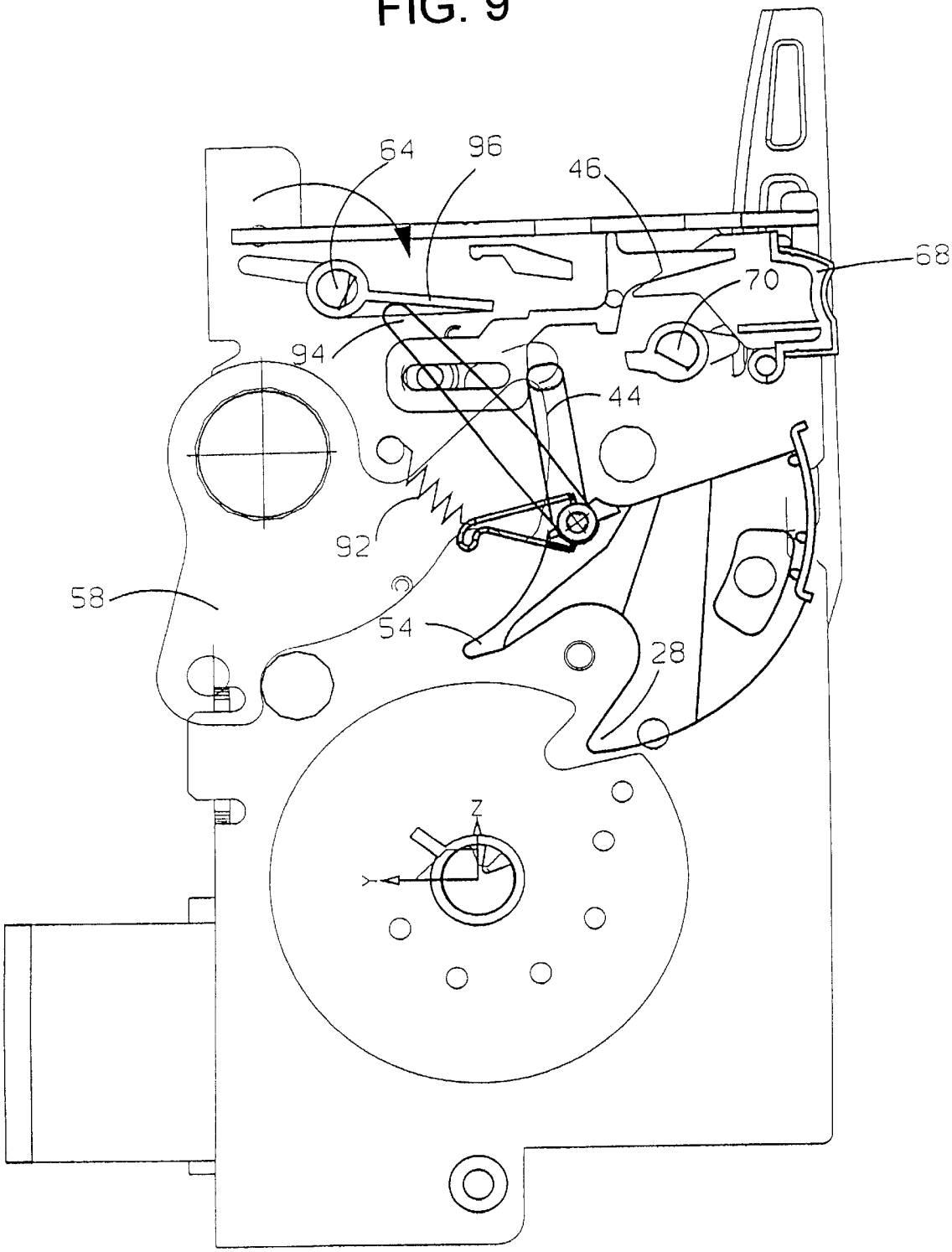
FIG. 9 represents the device of FIG. 6, in the latched open and loaded state.

If, on the other hand, from the position of FIG. 7, a permanent opening order is transmitted to the opening latch 64, the latter causes opening of the circuit breaker 12 but remains in an unlatched position represented in FIG. 9. In this position, the opening latch 64 interferes with the third arm 64 of the indicator 30, moving the indicator to its "loaded disengaged" position.

Various modifications can naturally be envisaged without departing from the scope of the invention. In particular, it is possible to provide for an indirect action of the opening latch on the indicator, by means of the slide rack. To do this, it suffices to provide on the one hand a bearing on the slide rack, able to cooperate with the opening latch in such a way that the slide rack is urged out of its cooperation position with the push-button when the latter takes its unlatching position and, on the other hand, a slot in the form of an arc of a circle on the slide rack, in which a finger borne by the fourth finger of the indicator comes and slides. When the opening latch moves to the unlatched position, it moves the indicator finger with it to the loaded latched position. When the indicator is in the ready to close position, the arc of a circle slot of the slide rack, centered on the sliding pivot of the rack, enables pivoting of the rack when the latter is urged by the closing push-button.

Furthermore, one or more electrical contacts can be provided giving an indication of the different states of the indicator. These contacts can be activated very simply by one or more cams securedly united to the indicator.

The invention has been described in relation to a circuit breaker. It is however also applicable to any switchgear apparatus with energy storage means, for example a switchgear apparatus operating as a switch. The switchgear apparatus can be singlepole, in which case the switching bar and the movable contact means can be totally secured to one another, or even be formed by a single part, or multipole. It may be limiting, in which case an articulation exists between the part of the contact means supporting the contact pads and the part of the contact means connected to the switching bar, or non-limiting, in which case this articulation is still not necessary.

The invention applies both to low-voltage switchgear apparatuses and to high-voltage switchgear apparatuses.

The indicator can be pivoting around an imaginary axis. It can also take the form of a slide rack moving in transaction in front of the window.

What is claimed is:

1. A switchgear apparatus, comprising:

at least one pole comprising at least one pair of contact means, at least one of the contact means of said at least one pair comprising a movable contact means movable in such a way that said at least one pair of contact means may assume an open position and a closed position, an opening spring, an energy storage means, a loading mechanism kinematically linked to the energy storage means to load the energy storage means in a loaded state regardless of a position of said at least one pair of contact means, a closing latch for locking the energy storage means in the loaded state, a kinematic system linking the energy storage means, the opening spring and the movable contact means in such a way that discharging of the energy storage means moves said at least one pair of contact means to the closed position and loads the opening spring, wherein the loaded opening spring biases said at least one pair of contact means to the open position, an opening latch for cooperating with the kinematic system and to assume a latched position in which the opening latch prevents said at least one pair of contact means from moving from the closed position to the open position, and an unlatched position in which, the opening latch does not prevent said at least one pair of contact means from moving from the closed position to the open position, an indicating device comprising an indicator kinematically linked to the loading mechanism for assuming a "not loaded" position and at least a second position, and to assume the "not loaded" position only when the energy storage means is not in the loaded state, a mechanical indicator of a "ready to close" state of the apparatus, kinematically connected to said at least one pair of contact means and to the opening latch, for assuming a "ready to close" position only when said at least one pair of contact means is in the open position, the energy storage means is loaded and the opening latch is in the latched position, wherein the indicator comprises the mechanical indicator of the "ready to close" state of apparatus, the "ready to close" position comprising a third position of the indicator, distinct from the "not loaded" position and from the second position of the indicator, the second position of the indicator being assumed when the energy storage means is loaded and the apparatus is not in the "ready to close" state.

2. The switchgear apparatus according to claim 1, wherein the indicator is kinematically linked to a transmission means disposed between a closing control means and the energy storage means, so that the transmission means is able to transmit a mechanical order from the closing control means to the closing latch only when the indicator is in the "ready to close" position.

3. The switchgear apparatus according to claim 2, wherein when the indicator is not in the "ready to close" position, the transmission means does not interfere with the closing control means, so that the closing control means is disengaged.

4. The switchgear apparatus according to claim 2, wherein the indicator comprises a cooperation surface able to cooperate directly or indirectly with the transmission means.

5. The switchgear apparatus according to claim 1, wherein the indicator is mounted pivoting around a spindle.

6. The switchgear apparatus according to claim 1, wherein the indicator comprises a cooperation surface able to cooperate directly or indirectly with the opening latch.

7. The switchgear apparatus according to claim 1, wherein the indicator comprises a cooperation surface able to cooperate directly or indirectly with the pair or pairs of contact means.

8. The switchgear apparatus according to claim 1, wherein the indicator comprises a cooperation surface able to cooperate directly or indirectly with the loading mechanism.

9. The switchgear apparatus according to claim 1, wherein the indicator comprises a cooperation surface able to cooperate directly or indirectly with an electrical switch to close the switch only when the indicator is in the "ready to close" position.

* * * * *